US005463864A

United States Patent [19]

Butler et al.

[11] Patent Number: 5,463,864

[45] Date of Patent: Nov. 7, 1995

[54] FUEL NOZZLE GUIDE FOR A GAS TURBINE ENGINE COMBUSTOR

[75] Inventors: Aaron S. Butler, Ledyard; Franklin J. Davis, Glastonbury, both of Conn.; Roger J. Comeau, Ware, Mass.

[73] Assignee: United Technologies Corporation, Hartford, Conn.

[21] Appl. No.: 173,036

[22] Filed: Dec. 27, 1993

[51] Int. Cl.[6] ..... F23R 3/60

[52] U.S. Cl. ..... 60/39.31; 60/39.32

[58] Field of Search ..... 60/39.31, 39.32, 60/740, 748, 756

[56] References Cited

U.S. PATENT DOCUMENTS

| | | | |
|---|---|---|---|
| 3,273,343 | 9/1966 | Cretella | 60/748 |
| 3,451,215 | 6/1969 | Barr | 60/39.32 |
| 3,589,127 | 6/1971 | Kenworthy et al. | 60/39.32 |
| 4,322,945 | 4/1982 | Peterson et al. | 60/39.32 |
| 4,365,470 | 12/1982 | Matthews et al. | 60/39.32 |
| 4,525,996 | 7/1985 | Wright et al. | 60/39.31 |
| 4,686,823 | 8/1987 | Coburn et al. | 60/39.32 |
| 4,870,818 | 10/1989 | Suliga | 60/740 |
| 4,934,145 | 6/1990 | Zeisser | 60/756 |
| 4,999,996 | 3/1991 | Duchene et al. | 60/39.32 |
| 5,222,358 | 6/1993 | Chaput et al. | 60/39.32 |

*Primary Examiner*—Timothy S. Thorpe
*Attorney, Agent, or Firm*—John Swiatocha

[57] ABSTRACT

An improved fuel nozzle guide (100) for a gas turbine engine combustion chamber (65) includes an eccentric detent (150) which allows only a predetermined amount of limited pivotable movement of a retainer (125) and bushing (105) employed in the guide.

3 Claims, 3 Drawing Sheets

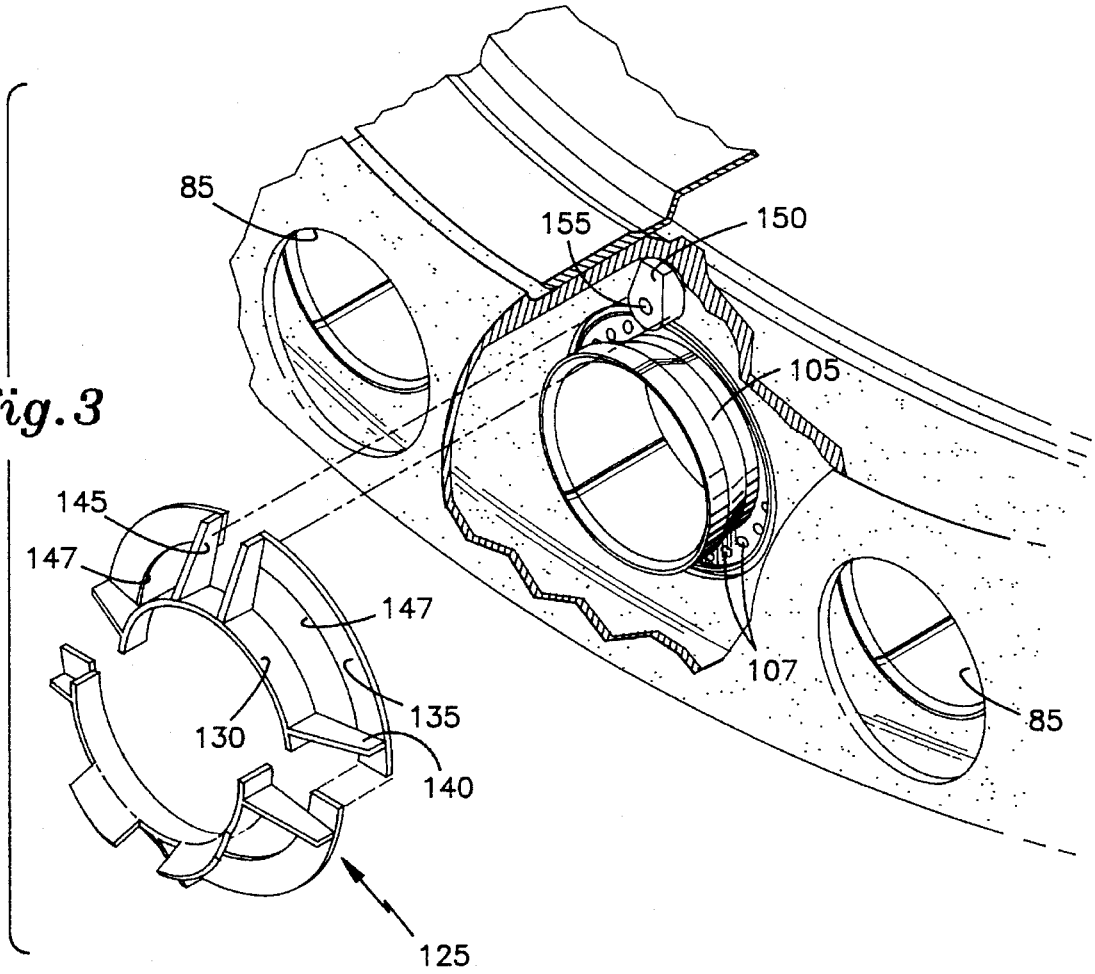
fig.3
fig.4
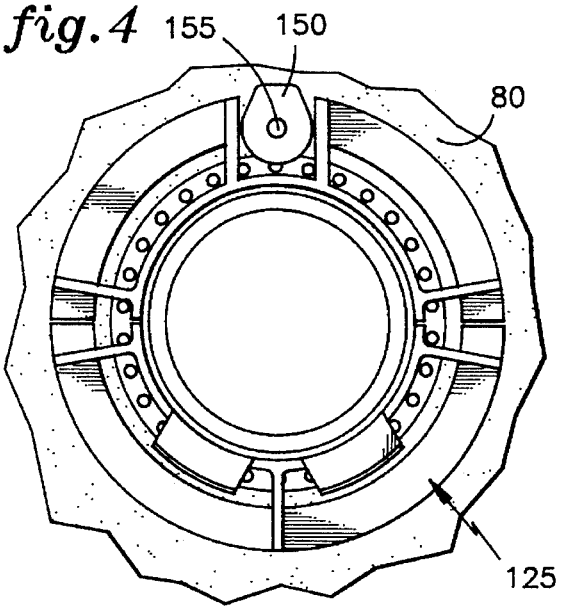
fig.5
prior art
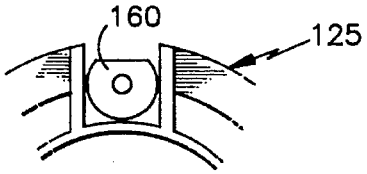
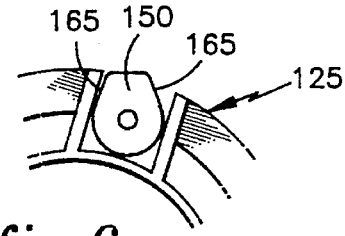
fig.6

FUEL NOZZLE GUIDE FOR A GAS TURBINE ENGINE COMBUSTOR

DESCRIPTION

1. Technical Field

This invention relates generally to gas turbine engine combustors and more specifically to improved fuel nozzle guides therefor.

2. Background Art

Typically, gas turbine engine burners include combustion chambers wherein air compressed by the engine's compressor, is mixed with fuel sprayed into the combustion chamber by a fuel nozzle which extends into the combustion chamber through a hole in the wall thereof. The air-fuel mixture is burned thereby increasing the kinetic energy of the airflow through the engine to produce useful thrust. An ignitor plug which functions similarly to a common spark plug in an automobile engine, provides an electrical spark which initiates the combustion.

To maintain the proper alignment of the fuel nozzle with the various other combustion chamber components such as the ignitor plug and various air inlet apertures, as well to aid in the insertion of the nozzle into the combustion chamber for burner assembly and maintenance, a multicomponent fuel nozzle guide which includes various cooling and combustion air apertures therein, is located in the hole in the combustion chamber wall through which the fuel nozzle extends.

It will be appreciated that the environment within a gas turbine engine combustion chamber is extremely harsh. The air fuel mixture burns in the combustion chamber at temperatures as high as 2100° C. (3800° F.) causing extreme thermal gradients and therefore, thermal stresses in the combustion chamber walls. Moreover, rotational movement of the engine's fan, compressor and turbine, as well as the high flow rate of the air-fuel mixture and the burning thereof, cause significant vibration in the combustion chamber walls. Such high thermal stresses and vibration experienced by the combustion chamber walls are, of course, also experienced by the fuel nozzle guide. It has been determined that prior art fuel nozzle guides could be improved upon, from the standpoint of exhibiting significant vibratory and even rotational movement in response to the harsh vibrational and thermal environment in the combustion chamber. Such movement risks not only the misalignment of the fuel nozzle with other components in the combustion chamber, but also misalignment of the various air apertures with one another and possible damage to the fuel nozzle guide themselves.

DISCLOSURE OF INVENTION

It is therefore, a principal object of the present invention to provide an improved fuel nozzle guide for a gas turbine engine combustor, which can tolerate the thermal and vibratory extremes encountered in gas turbine engine combustion chamber.

In accordance with the present invention, a fuel nozzle guide for a gas turbine engine combustor includes a retainer for securing the fuel nozzle and the remainder of the fuel nozzle guide to the bulkhead of the engine's combustor, the retainer being held in a nonrotational state by an eccentric detent mounted on the bulkhead and received within an opening in the retainer. The detent is of a length measured from the location on which it is mounted on the bulkhead to an end thereof, substantially greater than the width of the opening in the retainer. Thus, the detent is unable to rotate on its own mount, which would eventually lead to excess wear of the detent surface and thus excess movement and wear of the retainer. Such retainer movement would result in a chattering of the retainer, causing the accelerated the wear thereof and the misalignment of the retainer with other fuel nozzle guide components and the misalignment of the various cooling and combustion air apertures therein.

In the preferred embodiment, the detent includes outwardly (with respect to the center axis of the retainer) convergent edges allowing a small, predetermined degree of retainer pivoting for assembly and thermal stress accommodation without significant chatter. The outer surface of the retainer is chamfered to fit within and engage a corner defined by a main body portion of the combustion chamber bulkhead and a flange thereon to further limit unwanted detent and retainer rotation and chatter.

BRIEF DESCRIPTION OF THE DRAWINGS

FIG. 3 is an exploded isometric view of the fuel nozzle guide of the present invention;

FIG. 4 is a forward elevation of the fuel nozzle guide of the present invention assembled with the bulkhead of the combustion chamber of the engine's burner;

FIG. 5 is a fragmentary forward elevation of a prior art detent employed in a fuel nozzle guide similar to that of the present invention; and FIG. 6 is a fragmentary elevation similar to FIG. 4, but showing some acceptable level of pivoting by a retainer employed in the fuel nozzle guide of the present invention.

BEST MODE FOR CARRYING OUT THE INVENTION AND INDUSTRIAL APPLICABILITY THEREOF

Figure 1:
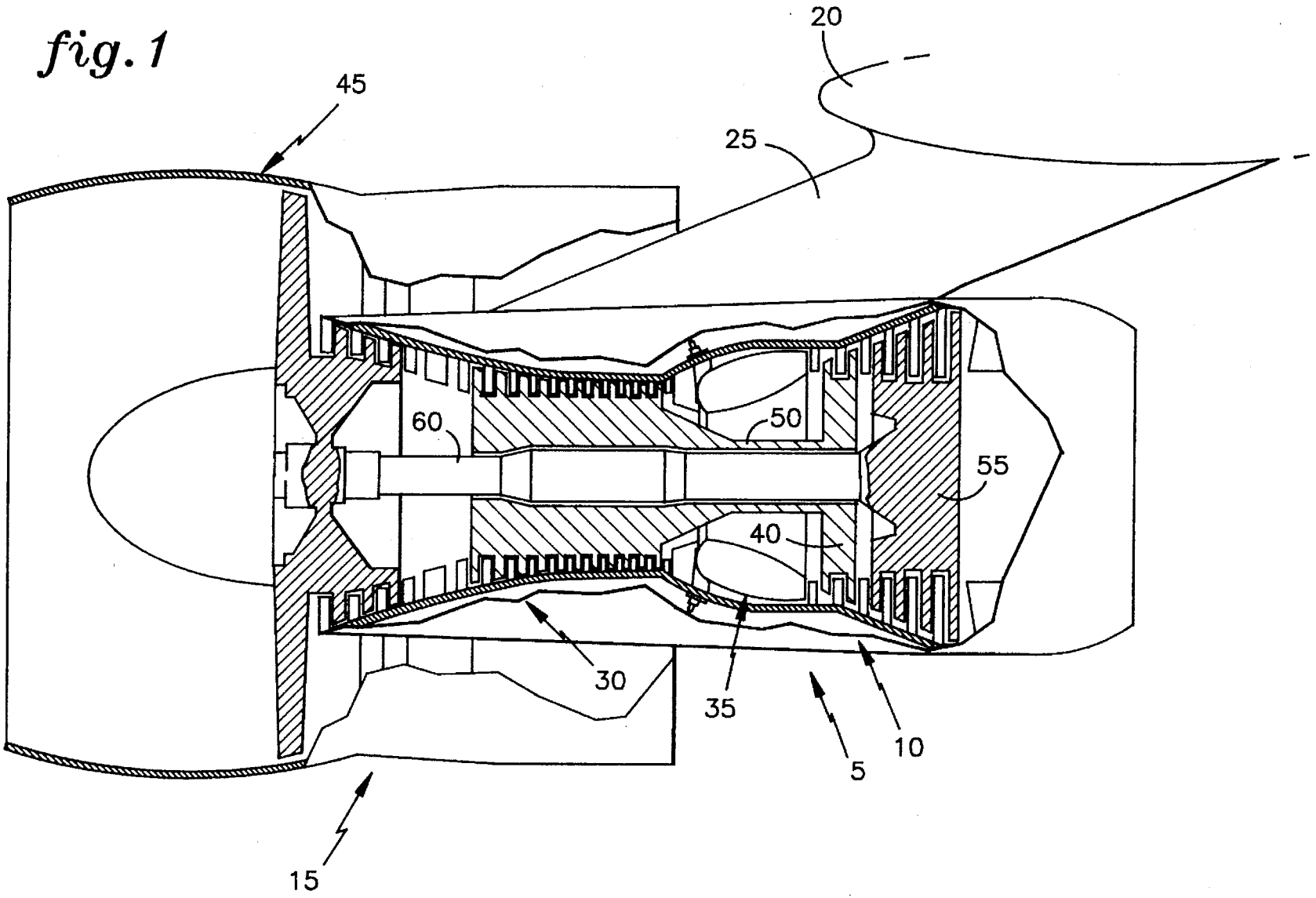
FIG. 1 is a sectioned, schematic elevation of a gas turbine engine of the type employing the fuel nozzle guide of the present invention.

Referring to FIG. 1, a gas turbine engine power plant 5 comprising an engine 10 disposed within a nacelle 15, is mounted on the wing 20 of an airframe (not shown) by pylon 25. As is well known in the art, engine 10 comprises a compressor 30 which receives ram air through the inlet of the nacelle and compresses that air, which is then ducted to burner 35 where the air is mixed with fuel and the mixture ignited, thereby substantially increasing the kinetic energy of the airflow through the engine. The products of combustion of the burned air-fuel mixture are expelled from the burner, impinging on the rotor blades of high pressure turbine 40 which is connected to the high pressure section of compressor 30 by axial drive shaft 50. The products of combustion from burner section 35 also impinge upon the rotor blades of low pressure turbine 55 which connects to the low pressure section of compressor 30 and fan 45 by coaxial drive shaft 60 to provide a motive force for driving the compressor and fan. The total thrust provided by the power plant is equal to the sum of the thrust of the exhaust of the engine and the thrust associated with the air discharged by the fan. The foregoing description of the structure and operation of power plant 5 is, of course, well known in the art.

Figure 2:
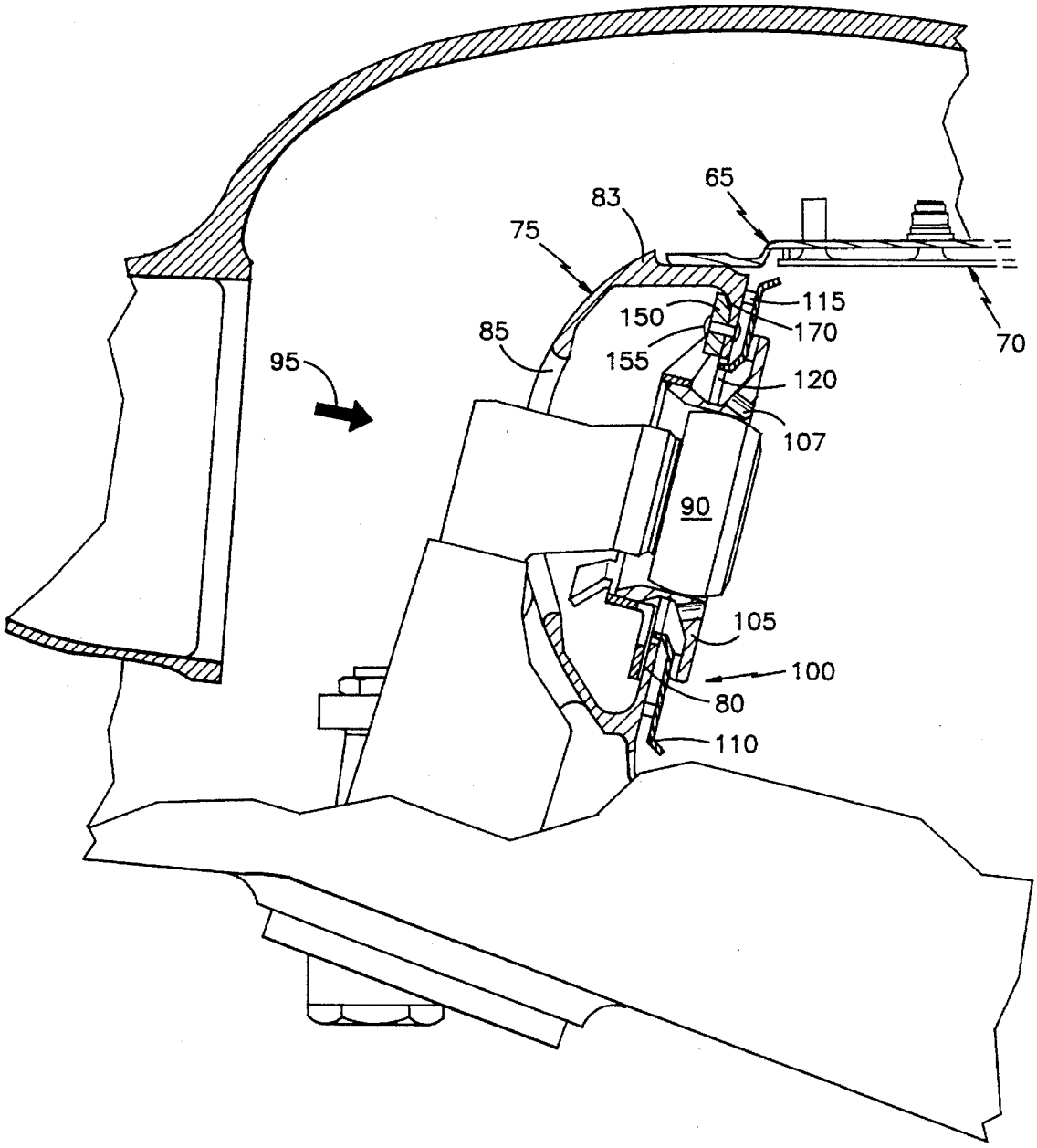
FIG. 2 is a sectioned, partial elevation of a burner of the engine shown in FIG. 1, illustrating the fuel nozzle guide of the present invention.

Referring to FIG. 2, burner 35 includes an annular combustion chamber 65 comprising a wall structure 70 terminating forwardly (with respect to the engine) at dome 75 including an integral, bulkhead 80 having a peripheral flange 83, and several openings, one of which is shown at 85, through which fuel nozzle 90 extends. Openings 85 also pass combustion air (indicated by arrow 95) to the interior of the combustor to support the combustion of fuel provided by nozzle 90 and cool the combustor components. The nozzle is attached to bulkhead 80 by nozzle guide structure 100.

Ignition of the mixture of air and fuel within the combustion chamber upon engine startup is provided by an ignitor plug (not shown). Still referring to FIG. 2, as set forth hereinabove, the high temperatures occurring in the combustion chamber cause the various components thereof to experience significant thermal transients and thermally induced differential expansion. Such differential expansion as well as vibration induced by gas flow through the combustor can result in longitudinal and transverse displacement of the fuel nozzle 90 relative to bulkhead 80. Nozzle guide structure 100 accommodates such differential displacement and vibration and aids in the assembly of the fuel nozzle with the remainder of the combustion chamber.

Guide structure 100 includes a nozzle guide bushing 105 disposed closely, but slidably, about fuel nozzle 90 and extending longitudinally through a central opening in bulkhead 80. A radially extending annular heat shield 110 (generally, of the type disclosed in U.S. Pat. No. 4,934,145), is disposed between bushing 105 and bulkhead 80, being spaced therefrom by a plurality of standoffs 115. The heat shield may be attached to the bulkhead by clamping with bushing 105, and by means of welding and threaded fasteners (not shown).

As shown, bushing 105 has an inner diameter substantially less than that of the opening in center of bulkhead 80. This defines an annular gap 120 therebetween for the admission of cooling and combustion air into the combustion chamber via openings 107 in bushing 105 and the space between the heat shield and the bulkhead.

Referring to FIGS. 2 and 3, bushing 105 is retained relative to bulkhead 80 by an annular retainer 125. Retainer 125 comprises an inner attachment ring portion 130 and an outer flange portion 135 either integral with ring portion 130 or attached thereto by welding or the like. Retainer 125 also includes a plurality of stiffening ribs 140 and slots 145 and 147 in flange 135, which accommodate airflow through hole 85 in dome 75 and into the combustion chamber. As best shown in FIG. 3, for ease of assembly, retainer 125 may be formed from two semi-annular members, or alternatively may be built-up into a single annular member. The retainer is attached to bushing 105 along the rear edge of ring 130. Further details of the guide structure and particularly of the flow of cooling and combustion air therethrough are provided in U.S. Pat. No. 4,870,818 assigned to United Technologies Corporation, the assignee of the present invention.

Referring to FIG. 4, the fuel nozzle guide of the present invention includes a detent 150 pivotally mounted on the outside surface of bulkhead 80 by a pin 155. The detent is received within one of the slots 145 in retainer 125 and, is of a length from the location of mounting pin 155 to the radially outer end of the detent, which is substantially greater than the width of slot 145. Thus, the detent is unable to rotate within slot 145.

Referring to FIG. 5, wherein a prior art detent 160 is illustrated, it will be appreciated that because the diameter of the detent is no greater than the width of the slot in retainer 125, the detent, in response to thermal and vibrational disturbances, may rotate fully within the retainer slot. Contact between the detent and the retainer as the detent rotates within the slot in response to vibration in the combustion chamber, causes the sides of the detent and slot to wear excessively, resulting in increased clearances between the detent and the retainer and increased pivotal movement of the retainer (and thus bushing 105). It will also be appreciated that the more the detent and retainer wear, the greater the clearances therebetween will become. As these clearances increase, pivotal movement (and wear) of the retainer and bushing. As the bushing and retainer wear increases, the location of air holes 107 is disturbed, thereby disturbing the optimal fuel-air mixture at the nozzle outlet and therefore the optimal combustion of the fuel-air mixture.

Referring to FIGS. 4 and 6, it will be seen that the detent has opposed outwardly convergent edges 165 whereby the width of the detent decreases in an outward direction. This allows some limited, acceptable pivotable movement of the retainer and bushing which is desirable for alignment of the fuel nozzle and guide structure during assembly and servicing of the combustor.

Referring again to FIG. 2, detent 150 is chamfered at a radially outer portion 170 of the aft major surface thereof. This chamfer allows the detent to fit in the corner defined by the juncture of flange 83 with bulkhead 80 and the outer edge of the detent to lie in close proximity to the flange. Thus, it will be appreciated that any pivoting of the detent beyond that accommodated by the tapered edges thereof will be opposed by engagement of the outer corners of the detent with the inner surface of the flange, as well as by the tapered edges of the detent with the sides of slots 145.

While a particular embodiment of the present invention has been shown and described, it will be appreciated that various changes may suggest themselves to those skilled in the art. For example, while a specific detent shape has been illustrated, it will be appreciated that various other equivalent shapes may be employed. Likewise, while specific embodiments of the retainer, bushing, bulkhead, and other combustion chamber components have been shown and described, various other configurations may be employed without departing from the present invention, and it is intended by the following claims to cover any and all such modifications as fall within the true spirit and scope of the present invention.

Having thus described the invention what is claimed is:

1. In a combustor for a gas turbine engine, said combustor comprising a combustion chamber defined at one end thereof by a bulkhead, said bulkhead including a fuel nozzle and guide structure therefor and a retainer for securing said fuel nozzle and guide structure to said bulkhead, said combustor further including means mounted on said bulkhead and extending through an opening in said retainer having a width and extending in a radial direction with respect to said retainer, for preventing relative rotational movement between said retainer and guide structure and said bulkhead, said rotation preventing means being characterized by:

a detent having a length measured in said radial direction and being pivotally mounted at a location on said bulkhead, within said opening but unattached thereto, such that the length of said detent from said location at which said detent is mounted on said bulkhead, to one end thereof is substantially greater than said width of said opening;

whereby complete rotation of said detent within said opening is prevented, thereby preventing accelerated vibration and wear of said detent and said retainer attendant with said detent rotation, during operation of said gas turbine engine.

2. The combustor of claim 1 further characterized by said detent having opposed outwardly convergent edges, whereby the width of said detent decreases in an outward direction, thereby allowing limited rotational movement of said fuel nozzle guide structure with respect to said detent for ease in the mutual alignment of said fuel nozzle and guide structure with said combustion chamber during the assembly of said combustor.

3. The combustion of claim 1 wherein said bulkhead comprises a generally planar portion terminating at a radially outer edge thereof at a generally perpendicular flange, said planar portion and flange defining a corner;

said detent being chamfered at an outer surface thereof to provide a clearance between said outer surface and said combustion chamber flange;

said detent end extending into said corner sufficiently to engage said flange in response to limited rotation of said detent, thereby preventing further rotation thereof.

* * * * *